United States Patent [19]

Deetz

[11] 4,084,680

[45] Apr. 18, 1978

[54] ENHANCED UNDERSCORING METHODS AND MEANS FOR AUTOMATIC TYPEWRITER AND THE LIKE EMPLOYING HAMMER-TYPE IMPACT PRINTING MECHANISM

[75] Inventor: David R. Deetz, Dallas, Tex.

[73] Assignee: Xerox Corporation, Stamford, Conn.

[21] Appl. No.: 813,060

[22] Filed: Jul. 5, 1977

Related U.S. Application Data

[63] Continuation of Ser. No. 622,564, Oct. 15, 1975, abandoned.

[51] Int. Cl.[2] ..... B41J 5/42; B41J 29/26

[52] U.S. Cl. ..... 197/19; 197/113; 364/900; 197/53

[58] Field of Search ..... 197/19, 20, 84 B, 113, 197/53, 157, 158, 166, 167; 340/172.5; 364/900

[56] References Cited

U.S. PATENT DOCUMENTS

| | | | |
|---|---|---|---|
| 3,630,336 | 12/1971 | Johnson et al. | 197/19 X |
| 3,707,214 | 12/1972 | Ponzano | 197/53 |
| 3,759,363 | 9/1973 | Castle et al. | 197/84 R |
| 3,782,521 | 1/1974 | Hengelhaupt | 197/158 |
| 3,812,945 | 5/1974 | Koplow et al. | 197/19 |
| 3,823,805 | 7/1974 | Richards | 197/19 |
| 3,844,397 | 10/1974 | Richards | 197/19 |
| 3,887,056 | 6/1975 | Lehmann | 197/151 X |
| 3,894,623 | 7/1975 | Miyawaki et al. | 197/19 X |
| 3,901,371 | 8/1975 | Scott | 197/53 |
| 3,912,065 | 10/1975 | Kashio | 197/19 |

*Primary Examiner*—Paul T. Sewell

[57] ABSTRACT

To enable an automatic typewriter or the like equipped with a hammer-type impact printer to print substantially straight and uniformly dense underscoring lines, provision is made for automatically forming multiple character underscores from a series of overlapping underscore characters. Moreover, to optimize the appearance of the underscoring, provision is made for automatically centering single or multiple character underscores relative to the character or characters which are to be underscored.

12 Claims, 7 Drawing Figures

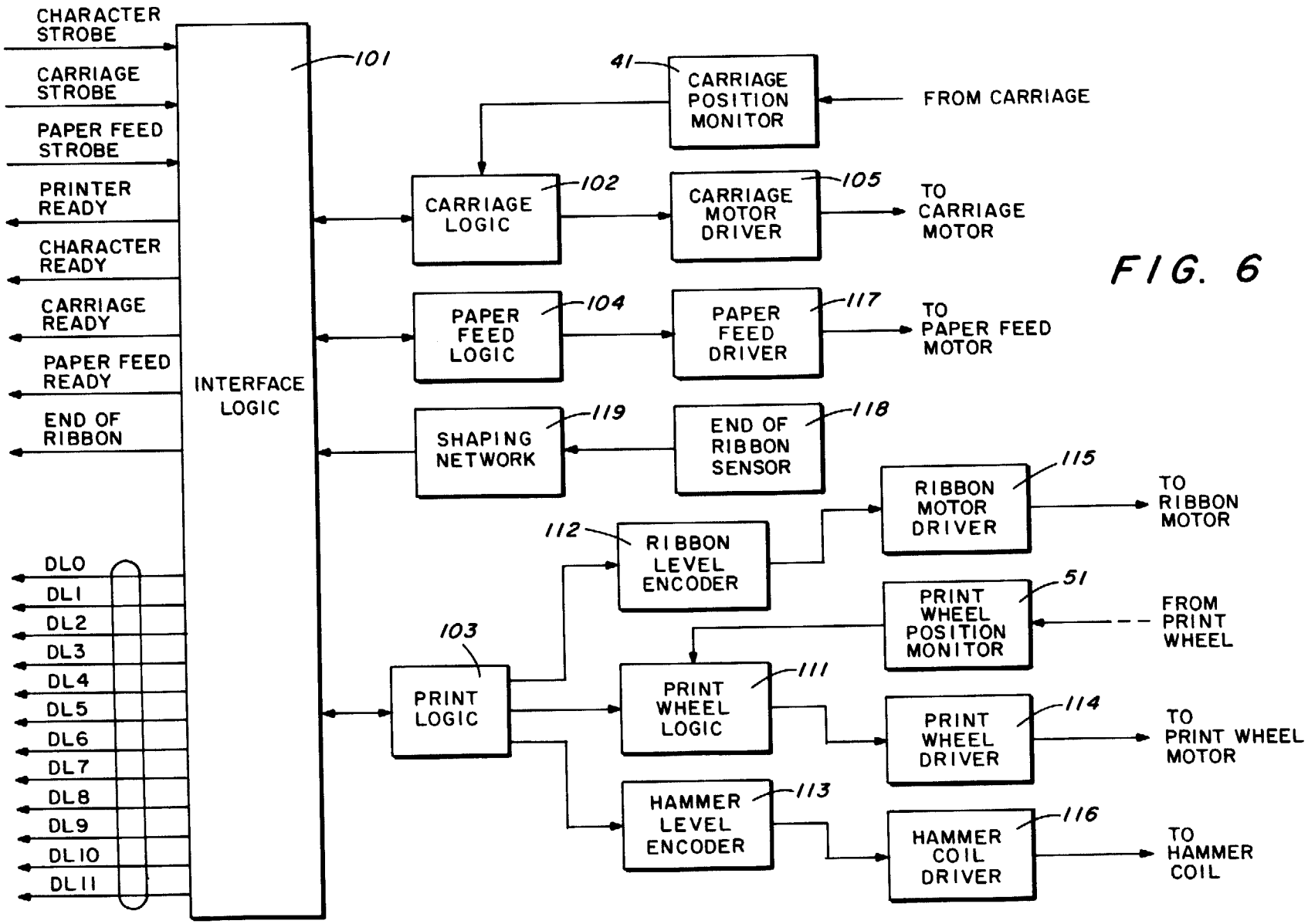
FIG. 6
FROM CARRIAGE
CARRIAGE POSITION MONITOR
41
CARRIAGE MOTOR DRIVER
105
TO CARRIAGE MOTOR
PAPER FEED DRIVER
117
TO PAPER FEED MOTOR
END OF RIBBON SENSOR
118
RIBBON MOTOR DRIVER
115
TO RIBBON MOTOR
PRINT WHEEL POSITION MONITOR
51
FROM PRINT WHEEL
PRINT WHEEL DRIVER
114
TO PRINT WHEEL MOTOR
HAMMER COIL DRIVER
116
TO HAMMER COIL
CARRIAGE LOGIC
102
PAPER FEED LOGIC
104
SHAPING NETWORK
119
RIBBON LEVEL ENCODER
112
PRINT WHEEL LOGIC
111
HAMMER LEVEL ENCODER
113
PRINT LOGIC
103
INTERFACE LOGIC
101
CHARACTER STROBE
CARRIAGE STROBE
PAPER FEED STROBE
PRINTER READY
CHARACTER READY
CARRIAGE READY
PAPER FEED READY
END OF RIBBON
DL0
DL1
DL2
DL3
DL4
DL5
DL6
DL7
DL8
DL9
DL10
DL11

ENHANCED UNDERSCORING METHODS AND MEANS FOR AUTOMATIC TYPEWRITER AND THE LIKE EMPLOYING HAMMER-TYPE IMPACT PRINTING MECHANISM

This is a continuation, of application Ser. No. 622,564, filed Oct. 15, 1975, now abandoned.

BACKGROUND OF THE INVENTION

This invention relates to hammer-type impact printers and, more particularly, to automatic typewriters and the like which rely on hammer-type impact printing mechanisms.

Hammer-type impact printing mechanisms are commonly found in computer printers where printing speed, rather than print quality, is the predominant concern. However, they may be advantageously utilized in high quality (e.g., typewriter quality) printers, as evidenced by the Xerox 800 Electronic Typing System, provided that suitable provision is made for enhancing the print quality.

One of the more difficult patterns for a hammer-type impact printer to produce is a straight, uniformly dense, multi-character line, such as a word or line length underscore. Typically, such a printer suffers from some "play" in the character and/or carriage positioning. Also, the inked ribbon or tape presented for underscoring purposes often includes both virgin and used stock. Thus, a multi-character tends to appear as a wavy, variably shaded line. That is, of course, aesthetically objectionable in automatic typewriters and the like which must satisfy high print quality standards.

SUMMARY OF THE INVENTION

Accordingly, an object of this invention is to provide a method and means for enabling a hammer-type impact printer to produce a substantially straight and uniformly dense multi-character line. More particularly, an object is to provide a method and means for enabling an automatic typewriter or the like with a hammer-type impact printing mechanism to produce a substantially straight and uniformly dense word or line length underscore. Specifically, an object is to provide a method and means for accomplishing that with an automatic typewriter which is selectively capable of printing fixed or proportional character spacing.

To realize these and other goals of the present invention, an automatic typewriter having a hammer-type impact printing mechanism includes means which are activated in response to an underscore command to determine the initial and final points for the underscore and means for then executing the underscore using a fraction of the normal character-to-character spacing to lay down or print one or more underscore characters in a pre-centered relationship between those points. If a plurality of underscore characters are called for, the reduced character-to-character spacing causes those characters to be printed in overlapping relationship, thereby providing a substantially straight and uniformly dense multi-character underscore.

BRIEF DESCRIPTION OF THE DRAWINGS

Still further objects and advantages of this invention will become apparent when the following detailed description is read in conjunction with the attached drawings, in which:

FIG. 6 is a more detailed block diagram of the printer section of the controller.

DETAILED DESCRIPTION OF THE ILLUSTRATED EMBODIMENT

While the invention is described in some detail hereinafter with reference to a single illustrated embodiment, it should be understood that there is no intent to limit it to that embodiment. On the contrary, the aim is to cover all modifications, alternatives, and equivalents falling within the spirit and scope of the invention as defined by the appended claims.

Figure 1:
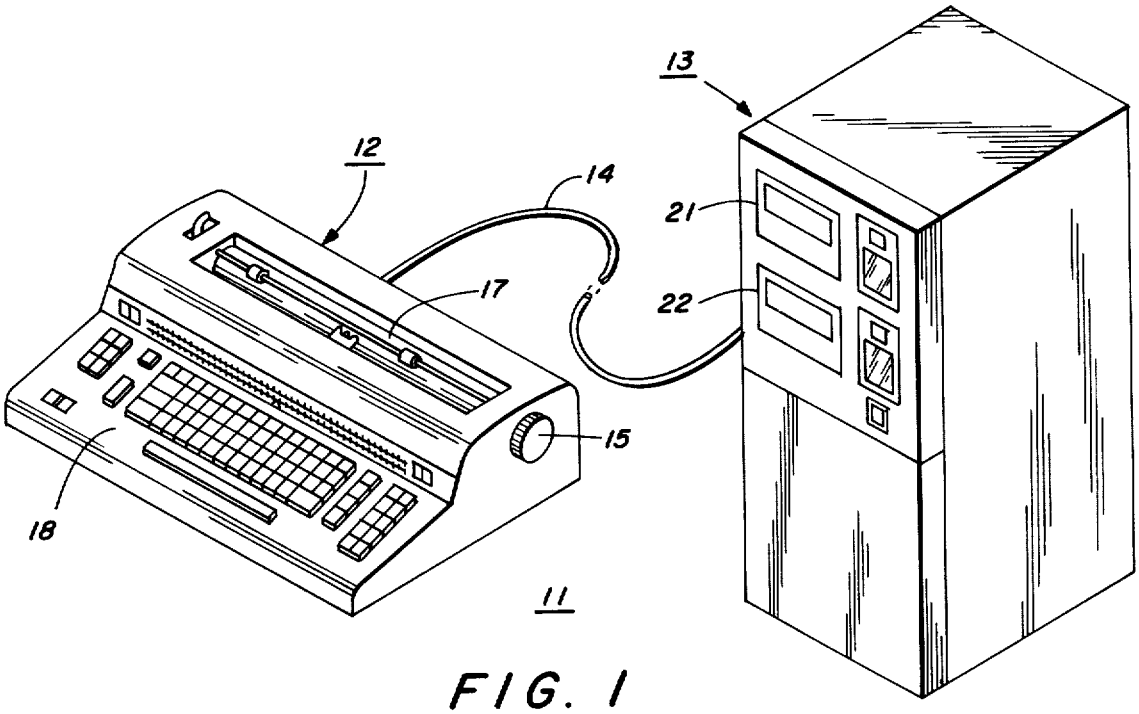
FIG. 1 is a simplified perspective view of an automatic typewriter with which the present invention may be advantageously utilized.

Turning now to the drawings, and at this point especially to FIG. 1, it will be seen that there is an automatic typewriter 11 comprising a printer 12 and a control console 13 which are interconnected by a multi-conductor cable 14. As described in substantial detail in copending and commonly assigned United States patent applications of H. Wallace Swanstrom et al., which were filed Jan. 2, 1974, under Ser. No. 429,479 and Oct. 15, 1975, under Ser. No. 622,780 (both of which are hereby incorporated by reference), the typewriter 11 is selectively operable in a record mode and in a play-back mode with fixed (i.e., ten or twelve pitch) or proportional character spacing.

Outwardly, the printer 12 has a reasonably standard typewriter-like appearance. There are thumbwheels 15 and 16 coupled to the opposite ends of a roll-like platen 17 (FIG. 2) so that an operator may load and manually advance paper or any other suitable copy carrier into and through the printer 12. Furthermore, there is a keyboard 18 including a customary complement of alphanumeric keys, together with several special function keys and levers which are discussed hereinafter to the extent necessary to understand this invention.

Customarily, paper is loaded into the printer 12 and one or more magnetic tape or card-type recording media are loaded into receptacles 21 and 22 on the control console 13 in preparation for operation of the typewriter 11 in its record or playback mode. During the record mode, appropriately coded alphanumeric characters and control commands are entered by the operator via the keyboard 18 at the printer 12 and then transferred through the cable 14 to the control console 13. The control console 13 serially responds to those coded data signals under program control to feed coded control signals and timing signals back through the cable 14 to the printer 12 so that a "rough draft" of what the operator is entering is generated in hard copy form. At the same time, the coded alphanumeric characters and control commands (i.e., the "data words") are stored within the control console 13 on one of the magnetic recording media. Conversely, in the play-back mode, the coded character and control commands are read from the recording medium by the control console 13 which, again, supplies coded control signals and timing signals for the printer 12 under program control. Those signals are fed through the cable 14 to the printer 12, thereby causing the printer 12 to produce a "final" edited or unedited, hard copy draft.

As will be appreciated, the foregoing is highly simplified. However, if the reader is interested in further details of the record, play-back, and editing functions of the typewriter 11, reference may be had to the aforementioned U.S. patent applications, Ser. Nos. 429, 479 and 622,780, and also to the commercially available Xerox 800 series of Electronic Typing Systems.

The printer 12 is substantially identical to the one described in a copending and commonly assigned United States patent application of Andrew Gabor, which was filed Sept. 4, 1973, under Ser. No. 394,072. Thus, that application is also hereby incorporated by reference. Nevertheless, a brief functional review of the printer 12 may be helpful.

Figure 3:
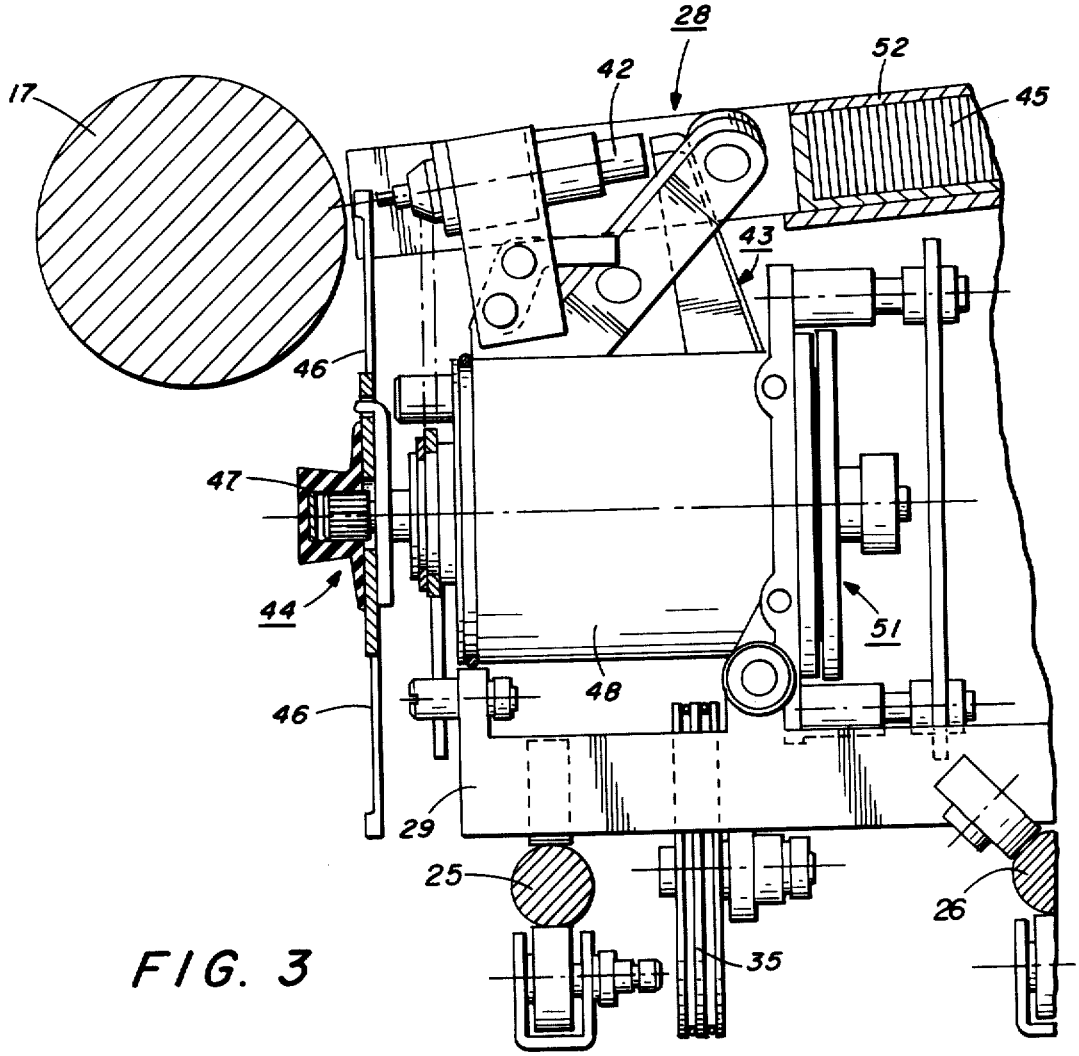
FIG. 3 is a sectional view taken along the line 3—3 in FIG. 2 to further illustrate the printing mechanism.
Figure 2:
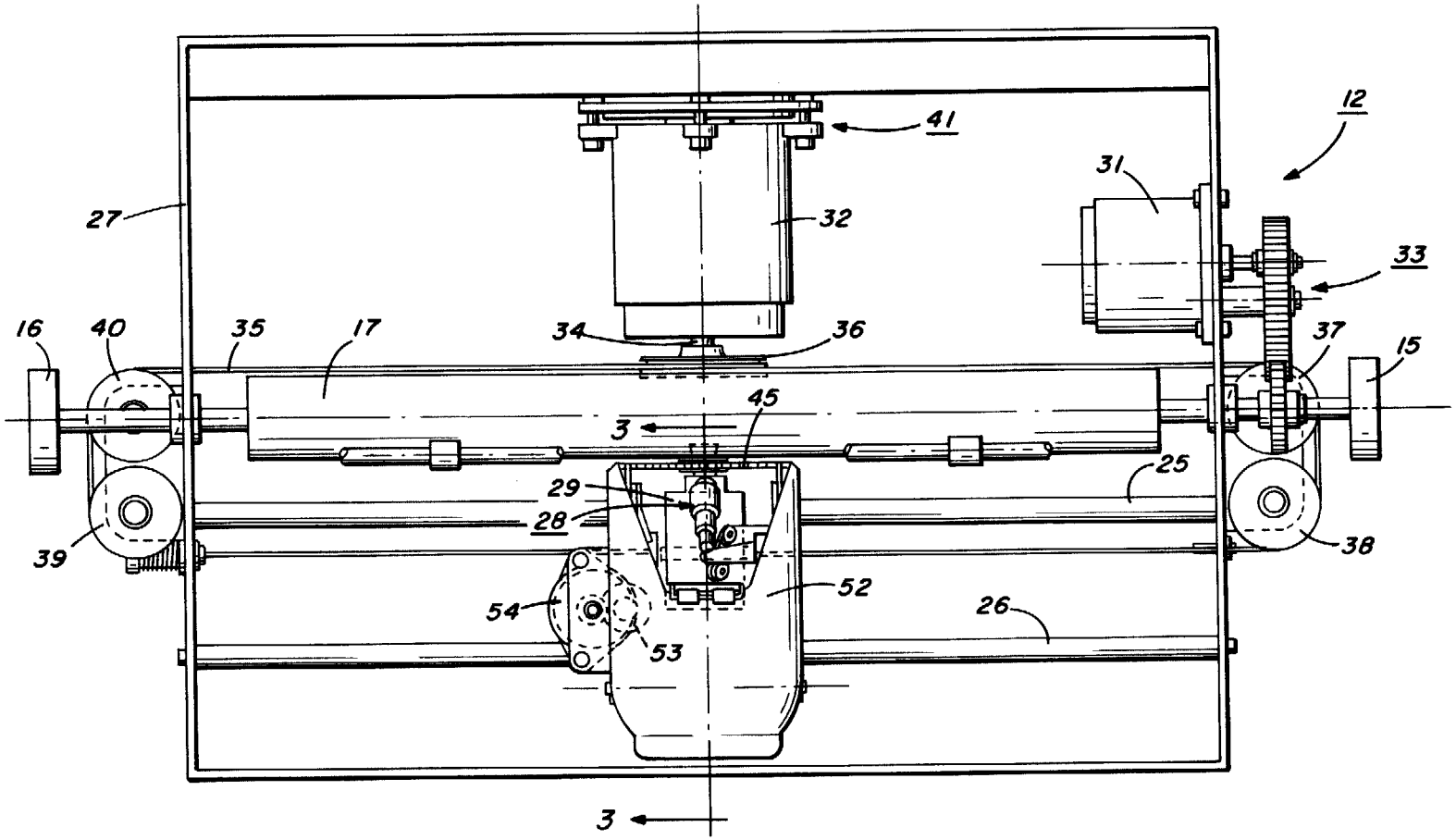
FIG. 2 is a plan view illustrating the printing mechanism of the printer for the typewriter shown in FIG. 1.

Referring to FIGS. 2 and 3 for purposes of that review, it will be observed that the platen 17 and a pair of parallel guide rods 25 and 26 are bridged between opposed sidewalls of a baseframe 27 for the printer 12. A hammer-type impact printing mechanism 28 is supported on a carriage 29 which is mounted on the guide rods 25 and 26 for movement transversely or lengthwise of the platen 17. Furthermore, there are a stepping motor 31 and a servomotor 32 mounted on the baseframe 27. The stepping motor 31 is coupled to the platen 17 by a gear train 33 so that the platen 17 is indexed when the motor 31 is activated to incrementally advance the paper through the printer 12. The servomotor 32, on the other hand, has one end of its drive shaft coupled to the carriage 29 by a cable 35 which is trained around a series of pulleys 36–40, and the other end of its drive shaft 34 coupled to, say, a shaft encoder 41. Thus, the carriage 29 is moved to translate the printing mechanism 28 lengthwise of the platen 17 when the servomotor 32 is actuated, while the encoder 41 supplies a signal which is representative of the actual position of the carriage 29 at any given time.

To carry out the printing function, as best shown in FIG. 3., the printing mechanism 28 comprises a hammer 42 which is propelled forwardly when an electromagnetic driver 43 is actuated to force a selected character or type element on a pre-positioned character wheel 44 into, say, an inked tape or ribbon 45 (FIG. 2) which, in turn, impacts against the paper supported by the platen 17, thereby printing a replica of the selected character. The character wheel 44 has a plurality of flexible arms 46 which extend radially from a central hub 47 to carry different characters. Another servomotor 48 has one end of its drive shaft 49 coupled to the hub 47 of the character wheel 44 and the other end of its drive shaft 49 coupled to, say, a second shaft encoder 51. Consequently, when the servomotor 48 is activated, the character wheel 44 is rotated as necessary to bring any selected one of its character carrying arms 46 into alignment with the hammer 42. Additionally, the encoder 51 supplies a continuously updated signal which is representative of the actual position of the character wheel 44.

As will be appreciated, the tape or ribbon 45 is a consumable. For that reason, a suitable supply is provided by a replaceable cartridge 52 which has a take-up spool 53 coupled to a stepping motor 54 so that a fresh section of tape or ribbon 45 may be advanced into position on command. If the ribbon advance per character equals or exceeds the width of the printed characters, most of the problems normally attributed to so-called "ink deletions" may be ignored. As a general rule, however, a "single strike" ribbon usage is uneconomical. Thus, the preferred practice is to minimize the ribbon advance increments to provide for a "multi-strike" ribbon usage, at least to the extent that more economical solutions can be found to the attendant ink deletion problems.

Figure 4:
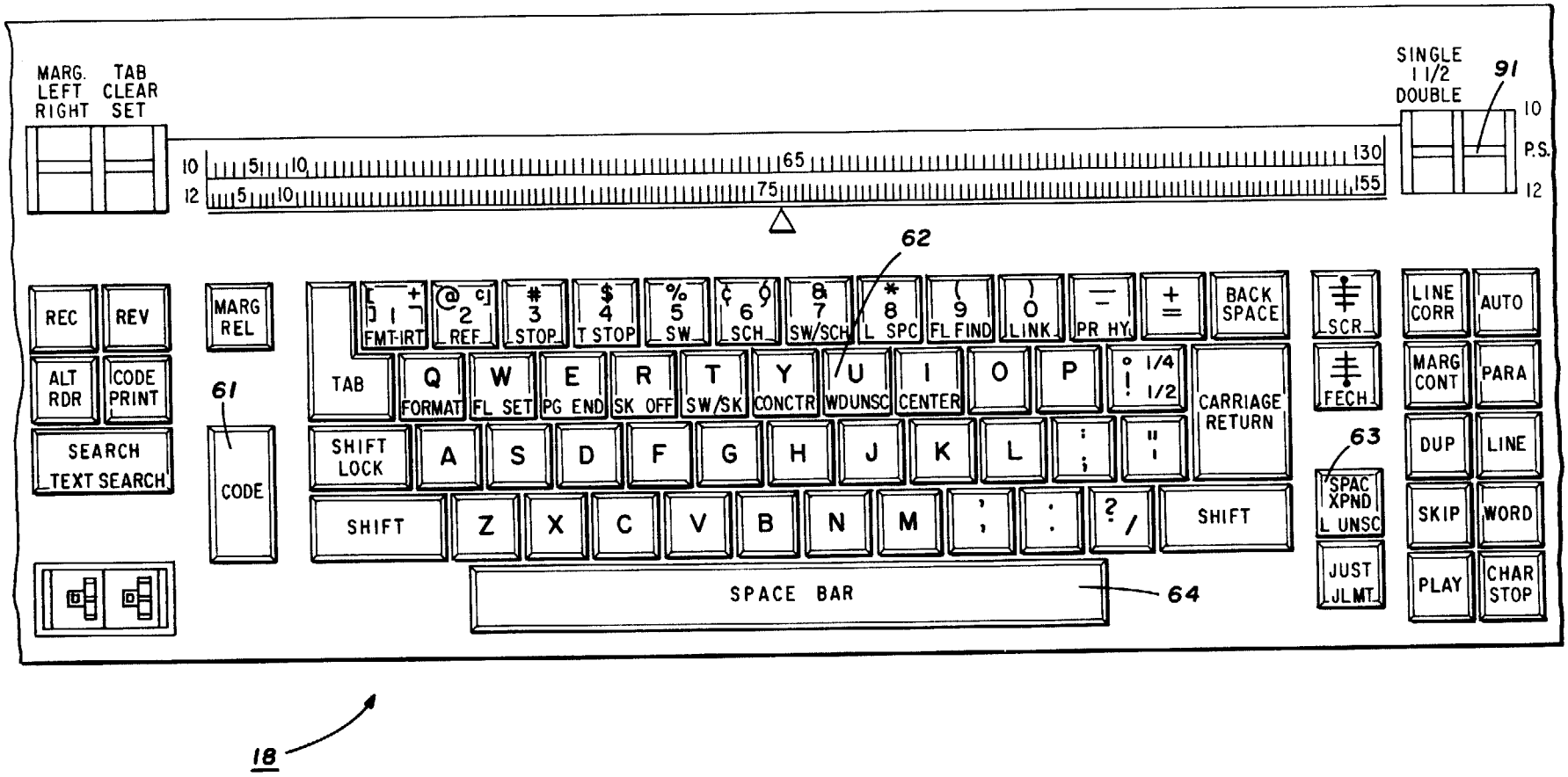
FIG. 4 is a plan view of a typical keyboard configuration for the printing unit of the typewriter shown in FIG. 1.

Turning next to FIG. 4, the operator's key strokes are translated by the keyboard 18 into an eight bit modified ASCII code word (e.g., a U.S. ASCII format). There are commercially available electronic keyboards capable of accomplishing that, including those which are manufactured by the Microswitch Division of Honeywell Corporation and those which are manufactured by The Keytronics Corporation. Also, the configuration of the kayboard 18 is described at some length in the aforementioned Swanstrom et al. applications, Ser. Nos. 429,479 and 622,780. Therefore, there is no reason to dwell on it at this point. Nevertheless, it should be noted that an eight bit code word format is selected, even though seven bits are ample to uniquely identify each of the characters, so that a predetermined one of the bits - viz., the last or eighth one - is available for signaling whether an underscore is called for or not. Specifically, the protocol for this particular embodiment dictates that the reserved or last bit of each code word is normally at a low ("0") logic level, but is subject to being forced to a high ("1") logic level in response to an underscore command.

The mechanics of entering an underscore command are straightforward. For a word length entry, the operator need only depress a code key 61 and an underscore encoded function key 62 after entering the final character of the word. For longer entries involving a plurality of spaced apart words, means are provided for generating a full eight bit code word, rather than the ordinary coded space command, for each of the inter-word spaces. Hence, the operator may enter the underscore command by depressing the code key 61 and the encoded function key 62 immediately after entering the final character of the last word to be underscored, in essentially the same manner as in the case of a word length underscore. To generate an appropriate code word for the inter-word spaces, the operator may depress a space expand key 63 or, alternatively, the code key 61 and the normal spacing bar 64.

Figure 5:
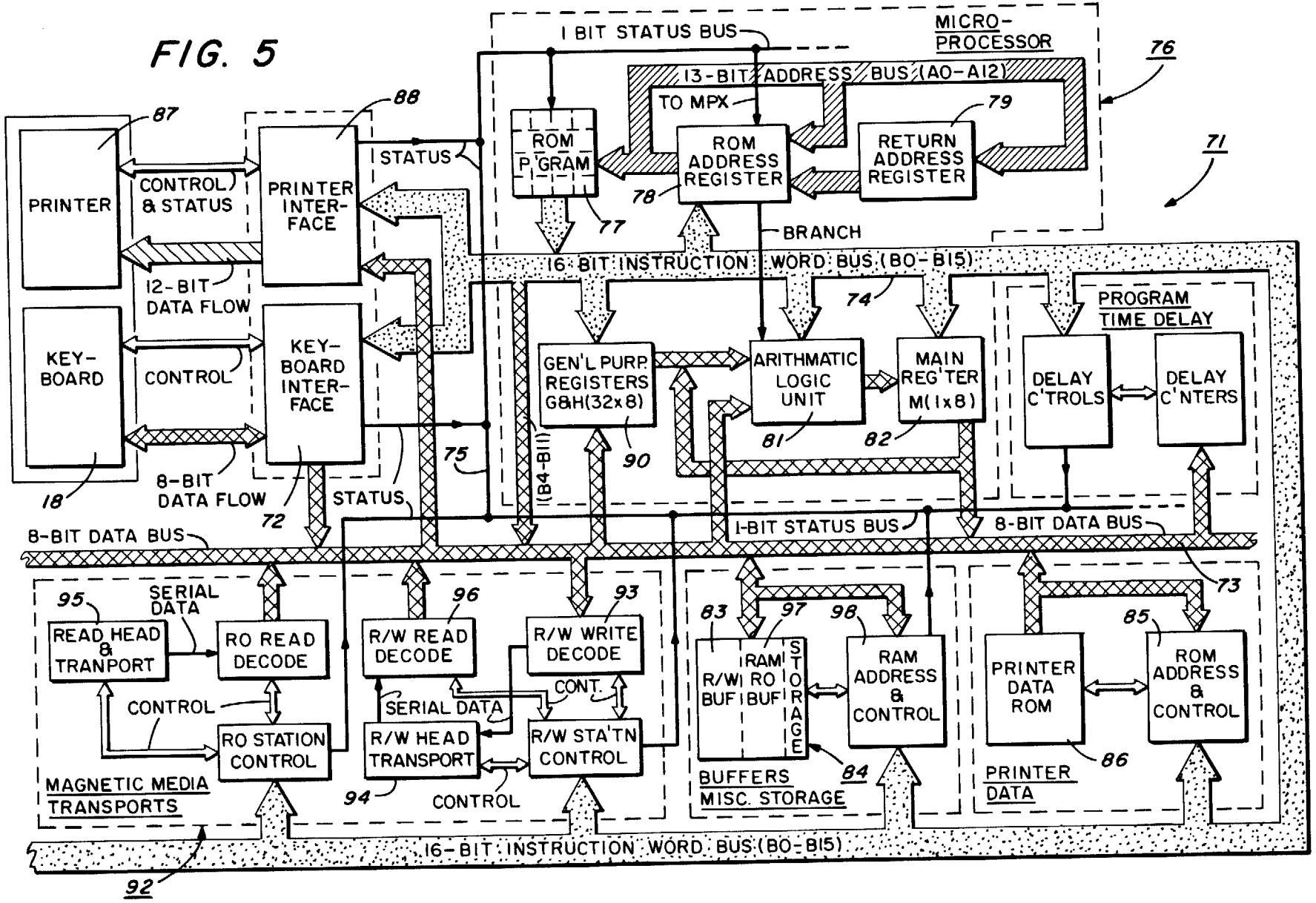
FIG. 5 is a generalized block diagram of the complete controller for the typewriter shown in FIG. 1.
Figure 7:
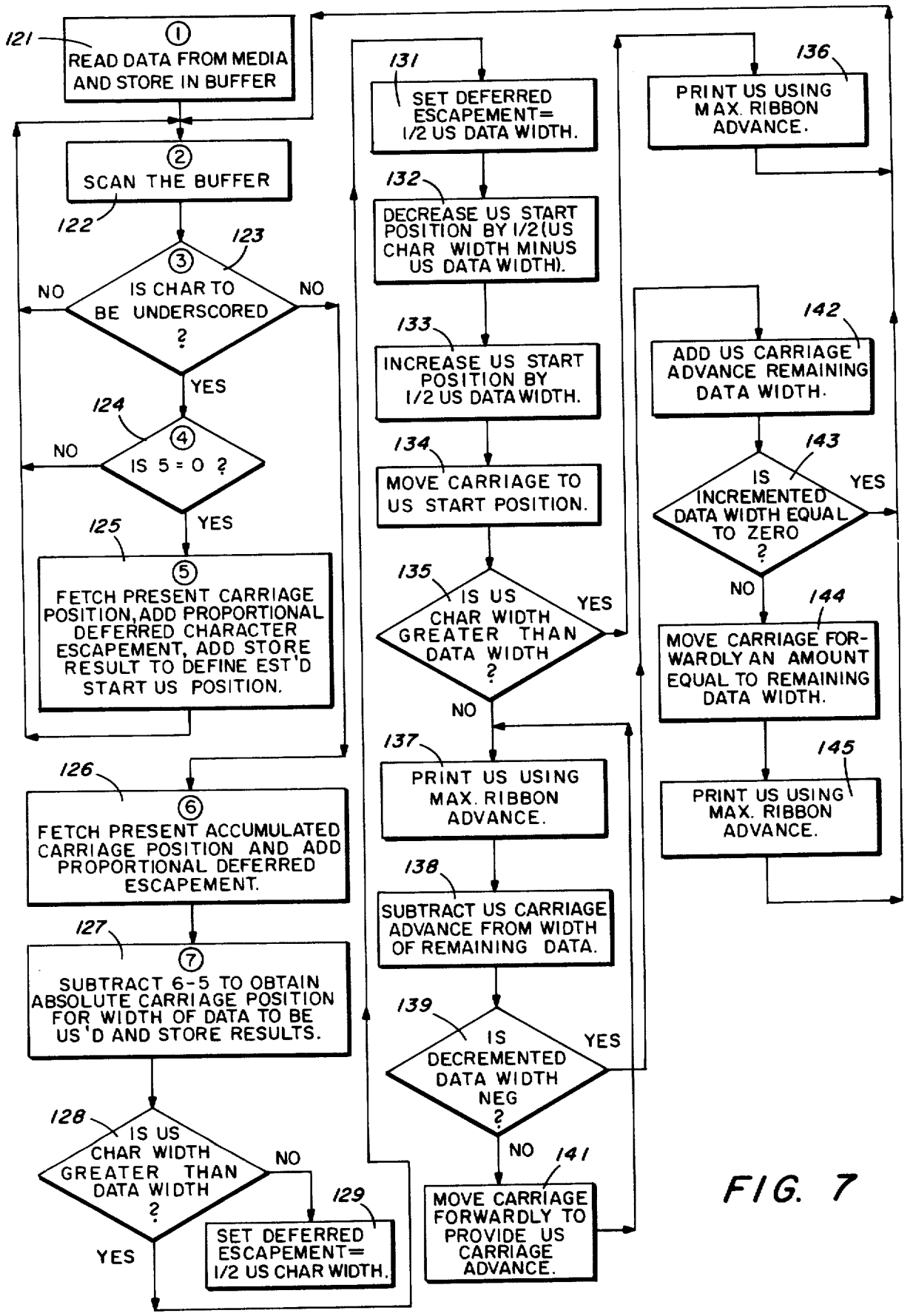
FIG. 7 is a flow chart illustrating the present invention as carried out under program control with the typewriter shown in FIG. 1.

Referring now to FIG. 5 for a review of the typewriter controller 71, it will be seen that the eight bits of each of the code words provided by the keyboard 18 are fed in parallel into a keyboard interface 72 where the code words come under program control. As a general rule, data-type code words circulate within the controller 71 with an eight bit parallel flow, while instruction-type code words circulate with a sixteen bit parallel flow. Any exceptions to that rule will be noted, but otherwise the following discussion will simply focus on the data words or the instruction words, as the case may be, without specific identification of the bit flow patterns for those words.

Again, the controller 71 and its various functions are fully described in the aforementioned Swanstrom et al. applications, Ser. Nos. 428,49 and 622,780. Thus, the emphasis here will be on those features which are directly relevant to the present invention.

As will be appreciated, the controller 71 is basically a single address processor. All data words are circulated via a common data bus 73, all instruction words are circulated via a common instruction bus 74, and all status information or flags are circulated via a common status bus 75. Furthermore, the addressing is carried out on more or less a first come, first served basis under the control of a microprocessor 76. To that end, the microprocessor 76 has a read only memory (ROM) 77 that is programmed to include an idle program which causes the microprocessor 76 to initially sample the status bus 75 sequentially for different, predetermined status flags. When such a status flag is detected, an address register 78 applies an appropriate thirteen bit (A0-A12) address code to the read only memory 77 which then shifts to the program routine called for by the detected status flag. Ordinarily, the least significant bit (A12) of the address code is incremented by the address register 78 once for each instruction performed, whereby the read only memory 77 sequentially feeds the sixteen bits (B0-B15) of adjacent or successive instruction words into the instruction bus 74. However, there is a return address register 79 coupled to the address register 78 for more radically incrementing or decrementing the address code applied to the read only memory 77 whenever branch, jump, or return addressing is required to enter or complete a selected processing routine.

Briefly, when a data word is fed into the keyboard interface 72, a status flag appears on the status bus 75, thereby causing the microprocessor 76 to shift or branch into a "data Presented from the Keyboard" routine. At the outset of that routine, the read only memory 77 issues an instruction word on the instruction bus 74 which causes the data word at the keyboard interface 72 to be gated onto the data bus 73. From there, the data word is transferred through an arithmetic logic unit 81 and then into a main register 82. Subsequently, further instruction words appearing on the instruction bus 74 first cause the data word to be loaded into a read/writer buffer section 83 of a random access memory (RAM) 84 and then cause the data word to be applied to an address and control means 85 for a second read only memory (ROM) 86.

The last bit of each data word, which is dedicated to signaling whether an underscore is called for or not, may be masked out at the address and control means 85. The seven other bits are sufficient to define an address code which causes the read only memory 86 to supply an appropriate twelve bit "escapement related" code word and an appropriate twelve bit "character related" code word in response to such a data word. Those twelve bit code words are sequentially assembled at the printer interface 88 in response to bits which are fed through the eight bit data bus 73. To that end, the read only memory 86 makes two successive passes at the data bus 73, under program control, for each escapement related code word and for each character related code word. Eight bits (only four of which are relevant) are provided on the first pass and eight more bits (all of which are relevant) are provided on the second pass.

Eleven of the twelve bits of each escapement related code word (e.g., the bits appearing on data lines DL0-DL11 in FIG. 6) define the amount of carriage movement called for, while the remaining or twelfth bit (i.e., the one applied to data line DL10) defines the desired direction of movement. The amount of movement is calculated by adding one-half of the width for the next character to one-half of the width of the preceding character. In other words, one half of the escapement for each character is deferred for use in defining the first part of the escapement for the next character. Appropriate escapement related code words are generated for ten or twelve pitch fixed character spacing on the basis of constants read from the read only memory 77 under program control. If, however, proportional spacing has been selected, the escapement related code words are formed from data stored in a set of general purposes registers 90, as described at length in the aforementioned Swanstrom et al applications, Ser. Nos. 429,479 and 622,780.

Contrastingly, in the case of a so-called character related code word, seven of the twelve bits (e.g., those applied to data lines DL0-DL6) define the character that is to be printed; three others (those applied to data lines DL7-DL9) define the ribbon advance called for by that character; and the final two (those applied to data lines DL10-DL11) define the impact energy which is to be imparted to the hammer 42 (FIG. 3) during the printing of such character.

Returning for a moment to FIG. 4, it should be noted that the per character escapement is subject to a degree of operator control. More particularly, there is a control switch or lever 91 on the keyboard 18 which the operator positions to select ten pitch, twelve pitch or proportional spacing. Typically, ten pitch spacing calls for a fixed escapement width of twelve units/character, twelve pitch spacing calls for a fixed escapement width of ten units/character, and proportional spacing calls for a variable escapement width ranging from six units/character for the narrowest characters (such as "i") to sixteen units/character for the widest characters (such as "W"). Suitably, the underscore character ("—") is assigned a width of five units/character for proportional spacing. In passing, it is worth mentioning that the foregoing example is based on a "unit" width of one-one hundred twentieth of an inch.

The controller 71 repeatedly recycles under program control as successive data words are fed into the keyboard interface 72 essentially as described above, until a full line of data words have been loaded into the read/write buffer 83, as indicated by the presence of a carriage return character. At that point, still another twelve bit "paper advance" code word (i.e., eleven bits of which define the amount of advance called for and the remaining bit of which defines the direction of the advance) is applied to the printer section 87 in response to a further set of constants read from the read only memory 77 under program control. Additionally, the contents of the read/write buffer 83 are then dumped in preparation for the processing of another line of data words.

If the typewriter 11 is operating in a record mode, the contents of the read/write buffer 83 are dumped into a read/write section 92 for recording on the recording medium. To that end, the several data words stored within the read/write buffer 83 are sequentially routed, under program control, through the data bus 73 and the arithmetic logic unit 81 to the main register 82 and then back through the data bus 73 and a read/write decoder 93. The read/write decoder 93 functions as a parallel to serial converter, whereby the several bits of each code word are sequentially recorded on a recording medium associated with a read/write head transport 94.

As will be noted, provision is made in the read/write section 92 for transferring data recorded on the recording medium associated with the transport 94 to another recording medium associated with a second transport 95, whereby recorded data words may be selectively edited or otherwise revised and then re-recorded in revised form. However, that aspect of the typewriter 11 is beyond the scope of this invention and, therefore, need not be reviewed in any further detail.

To print in response to pre-recorded data words on the recording medium associated with the read/write head transport 94, the typewriter 11 is placed in an appropriate play-back mode. That causes the recorded data to be read, under program control, into a read/-write decoder 96 which functions as a serial to parallel converter to sequentially apply the original eight bit code words to the data bus 73. From there, each of the data words is routed under program control through the arithmetic logic unit 81 to the main register 82 and then back through the data bus 73 to a read only buffer section 97 of the random access memory 84. As soon as a full line of data words have been read into the read only buffer 97, there is a pause in the reading of data from the recording medium. During that pause, the data words stored in the buffer 97 are sequentially dumped, under program control, through the data bus 73 and the arithmetic logic unit 81 to the main register 82 which, in turn, feeds the successive data words to the read/write buffer section 83 of the random access memory 84 and to the address and control means 85 for the read only memory 86. At that point, the controller 71 is conditioned to carry out the same printing routine as was previously described in connection with raw data words generated by the operator through the use of the keyboard 18.

As will be recalled, a predetermined one of the bits - viz., the last or eighth one - of each of the data words is reserved for signaling whether or not a command has been entered to underscore the character represented by the particular data word. Thus, all data words are initially entered with that bit at a first or low ("0") logic level, and provision is made for forcing that bit to a second or high ("1") logic level in response to an underscore command.

More particularly, when an underscore command is entered, a status flag is set on the status bus 75 which causes the read only memory 77 to apply a search instruction word to the instruction bus 74. In response to that instruction, an address and control unit 98 for the random access memory 84 initiates a search in the reverse direction through the contents of the read/write buffer 83 (i.e., the search starts with the most recently entered data word and progresses back toward the first entered data word) looking for a "non-printing" character, such as a tab or an uncoded space. Each data word passed over during the course of that search is modified, under program control, by forcing its eighth or last bit (i.e., the bit reserved for signaling whether an underscore command has been entered or not) from a low ("0") logic level to a high ("1") logic level.

Referring now to FIGS. 2, 3 and 6, to drive the printer 12 in response to the aforementioned "character related", "escapement related", and "paper advance" code words, the printer section 86 of the controller 71 includes an interface 101 for gating escapement related code words to a carriage logic unit 102, character related code words to a print logic unit 103, and paper advance code words to a paper feed logic unit 104. As described in more detail in the aforementioned Swanstrom et al. applications, Ser. Nos. 429,479 and 622,780, the gating of those code words is carried out in response to carriage strobe, character strobe, and paper feed strobe commands, respectively, which are applied to the interface 101 under the control of instructions issued by the read only memory 77. Those instructions are issued whenever a print routine is called for, subject to the timely receipt at the read only memory 77 of appropriate printer ready, character ready, carriage ready, paper feed ready and end of ribbon status signals.

Concentrating on the highlights of the printer section 87, it will be understood that the application of a carriage strobe command to the interface 101 while an escapement related code word is on the data lines DL0-DL11 enables the carriage logic 102 to compare the actual position of the carriage 29, as defined by the signal supplied by the position monitoring shaft encoder 41, against the desired or set point position defined by the code word. Any deviation of the actual position from the desired position is converted by the carriage logic 102 into an error signal having an amplitude proportional to the amount of deviation and a sense or polarity representative of the direction of the deviation. Moreover, a carriage motor driver 105 actuates the servomotor 32 in response to that error signal, whereby the carriage 29 is moved into its desired position. The null condition which exists when that position is reached triggers the carriage logic 102 to feed an appropriate carriage ready signal through the interface 101.

Coincidence of a character strobe command and a character related code word at the interface 101 is sensed by the print logic 103 which then routes the character defining bits on data lines DL0-DL6 to a print wheel logic circuit 111, the ribbon advance controlling bits on data lines DL7-DL9 to a ribbon advance decoder 112, and the hammer impact energy defining bits on data lines DL10-DL11 to a hammer level decoder 113.

The print wheel logic 111 relies on the character defining bits and the signal supplied by the print wheel position monitoring shaft encoder 51 to generate an error signal having an amplitude proportional to the angular displacement (as measured through the smallest or minor angle) of the print wheel 44 from its desired position and a sense or polarity representative of the direction of that displacement. A print wheel driver 114 actuates the print wheel servomotor 48 in response to that error signal, whereby the print wheel 44 is rotated as necessary to bring the desired character into alignment with the hammer 42.

In preparation for printing that character, the stepping motor 54 is actuated by a signal supplied by a ribbon motor driver 115 in response to the bits applied to the ribbon advance decoder 112, whereby an appropriate length (typically appreciably less than a full character width to gain the economies of "multistrike" usage) of fresh tape or ribbon 45 is brought into alignment with the hammer 42. Thereafter, the coil (not shown) of the electromagnetic driver 43 is energized by a signal supplied by a hammer coil driver 116 in response to the bits applied to the hammer level decoder, thereby causing the driver 43 to impart a preselected amount of impact energy to the hammer 42. Finally, a character ready status signal is fed back through the interface 101 to indicate that the print logic 101 is ready to accept another character related code word.

Coincidence of a paper feed strobe signal and a paper advance code word at the interface 101 enables the paper feed logic 104. Under those conditions, the stepping motor 31 is energized by a signal supplied by a paper feed driver 117 in response to the paper advance code word applied to the paper feed logic 104. Furthermore, the paper feed logic 104 thereafter feeds a paper feed ready status signal back through the interface 101 to indicate that it is prepared to receive another paper advance code word.

The supply of inked tape or ribbon remaining in the cartridge 52 is monitored by an end of ribbon sensor 118. Whenever that supply approaches exhaustion, the sensor 118 feeds a warning signal through a shaping network 119 and the interface 101 to provide an end of ribbon status signal which causes the microprocessor 76 to transfer to a "not ready" status.

In accordance with the present invention, provision is made for executing a special underscore routine whenever an underscore is called for by an appropriate command to the end that the underscore is printed as a centered, substantially straight, and more or less uniformly dense line. Essentially the same routine applies, regardless of the operating mode the typewriter 11 happens to be in. Hence, a description of the routine as carried out during, say, the play-back mode will suffice.

The read only memory 77 issues instructions, as indicated at 121, which cause pre-recorded data words to be loaded on a line-by-line basis into the read/write buffer section 83 of the random access memory 84 during the play-back mode. After each line of data words has been loaded, the read/write buffer 83 is scanned under program control, as indicated at 122, so that the data words are sequentially dumped into the address and control unit 85 for the read only memory 86. During that process, the logic level of the last or eight bit of each data word is examined, as indicated at 123, to determine whether an underscore is called for or not. If that bit is at a first or low ("0") logic level, the character called for by the data word is printed without entering the underscore routine. But, if that bit is at a second or high ("1") logic level, the underscore routine is entered as the character associated with the data word is being printed.

At the outset of the underscore routine, the read only memory 77 conducts a status check, as indicated at 124, on the general purpose registers 90 to determine whether a predetermined storage location therein is clear. An affirmative response to that status check uniquely identifies the first of any number of consecutive data words associated with an underscore command. Accordingly, when such a response is received, the read only memory 77 issues an instruction, as indicated at 125, which causes a code word representative of the present position of the carriage 29 plus the deferred escapement for the character defined by the immediately preceding data word to be stored within the general purpose registers 90 at the aforementioned storage location. For convenience, that code word is hereinafter referred to as defining an "estimated start of underscore position."

Advantageously, a second storage location within the general purpose registers 90 is dedicated to storing a code word which is appropriately incremented or decremented each time an escapement related code word is applied to the printer section 87 of the controller 71 such that the stored code word tracks the current position of the carriage 29 plus the deferred escapement for the last character that was printed. As will be recalled, the deferred escapement for that character is defined by constants supplied by the read only memory 77, if a ten or twelve pitch fixed spacing has been selected, or by the three ribbon advance defining bits provided by the read only memory 86, if a proportional spacing has been selected. Of course, a continuously updated code word of above-mentioned type may be readily transferred on command into the first storage location within the registers 90, thereby providing the desired code word representative of the estimated start position for an underscore.

Once a data word having an underscore command has been detected, the underscore routine simply recycles until a data word without an underscore command is detected. The examination 123 of any intervening data words causes the status check 124 to be repeated, but that check or inquiry is met with a negative response, thereby causing the routine to recycle to the scan buffer instruction 122.

However, when a data word without an underscore command is detected, the scanning of the buffer 83 is temporarily suspended so that no further data words are dumped until the underscore has been printed. Additionally, the read only memory 77 issues an instruction, as indicated at 126, which causes a code word representative of the existing position of the carriage 29 plus the deferred escapement for the immediately preceding character to be assembled in a third storage location within the general purpose registers 90, thereby defining an "estimated end of underscore position." Again, that code word may be readily assembled by transferring the position tracking code word into the desired storage location.

To center the underscore, the read only memory 77 next issues an instruction, as indicated at 127, whereby the estimated end of underscore position is subtracted from the estimated start of underscore position by means of a differential code word-to-code word comparison to provide a new code representative of the width of the data to be underscored. That data width code word is entered into a fourth storage location within the registers 90. A comparison is then made, as indicated at 128, to determine whether the standard width of the underscore character is greater than or less than the width of the data to be underscored.

If the comparison 128 shows that the width of the data to be underscored is greater than the width of the underscore character, the deferred escapement for the character immediately preceding the data to be underscored is reset in response to an instruction issued by the read only memory 77, as indicated at 129, to equal one-half the underscore character width, thereby ensuring that the left-hand end of the underscoring line will vertically align with the forward or left-hand edge of the first character to be underscored. Conversely, if the comparison 128 indicates that the underscore character width is greater than the width of the data to be underscored, the deferred escapement for the character preceding the data to be underscored is reset in response to a different instruction issued by the read only memory 77, as indicated at 131, so that it equals one-half the width of the data to be underscored. Moreover, another instruction is then issued, as indicated at 132, whereby the code word providing the so-called estimated start of underscore position is decremented by a quantity representative of one-half the amount by which the underscore character width exceeds the width of the data to be underscored. That ensures that the underscore line will be printed with equal length borders on either side of the underscored character.

After the centering steps of the routine have been carried out, the read only memory 77 issues a further instruction, as indicated at 133, whereby the code word providing the estimated start of underscore position is incremented by an amount equal to one-half the width of the underscore character. That code word then defines a calculated start of underscore position. Hence, the read only memory 77 next issues an instruction, as indicated at 134, to generate an escapement related code word in response to the calculated start of underscore position code word, whereby the carriage 29 is backed up or repositioned to the calculated start of underscore position in preparation for printing the underscore.

However, before the underscore is printed, the width of the underscore character is again compared with the width of the data to be underscored, as indicated at 135. If the character width exceeds the data width, the read only memory 77 supplies an instruction, as indicated at 136, whereby a character related code word is fed from the read only memory 86 to the printer section 87 to cause the underscore character to be printed with the maximum permissible ribbon advance, while the read only memory 77 is preparing to issue the scan buffer instruction 122. If, on the other hand, the data width exceeds the character width, the read only memory 77 continues with the underscore routine. That is, the first instruction issued under those circumstances is, as indicated at 137, to feed a character related code word from the read only memory 86 to the printer section 87 so that an underscore character is printed with the maximum permissible ribbon advance. The read only memory 77 does not then recycle to the scan buffer instruction 122. Instead, it issues a further instruction 138, whereby the code width representative of the width of the data to be underscored is decremented by an amount representative of the pre-selected character-to-character carriage advance for underscoring purposes.

In keeping with an important feature of this invention, the character-to-character carriage advance for underscoring purposes is selected to be only a fraction, say one-third or so, of the width of the underscore character. As a result, adjacent underscore characters overlap, thereby forming a substantially straight underscoring line, regardless of ordinary play in the positioning of the carriage 29 and/or the print wheel 44. Moreover, the reduced or fractional character-to-character underscore advance reduces the number of strikes per unit length of the inked ribbon or tape 45 so that a multi-character underscore is printed with a substantially uniform density.

Returning to the description of the underscore routine, it will be seen that, after the width of the data to be underscored has been decremented, as indicated at 138, the read only memory 77 furnishes a further instruction 139, calling for a comparison of the underscore character width with the decremented data width. At that point, the decremented data width represents the width of the data remaining to be underscored.

If the comparison 139 shows that the width of the data remaining to be underscored exceeds the width of the underscore character, the read only memory 77 issues an instruction 141, whereby the escapement related code word applied to the printer section 87 is incremented by an amount representative of the preselected underscoring carriage advance to thereby cause the carriage 29 to move into position for printing the next underscore character. Following that, the read only memory 77 returns to the print instruction 137, and the process is then repeated, until the comparison 139 indicates that the underscore character width is greater than the width of the data remaining to be underscored.

At that point, an alignment process is carried out to ensure that the right-hand end of the last underscore character vertically aligns with the trailing or right-hand edge of the last character to be underscored. To that end, the read only memory 77 first issues an instruction, as indicated at 142, calling for the incrementing of the code word representing the data remaining to be underscored by an amount representative of the carriage advance selected for underscoring purposes. The incremented data remaining code word is then examined, as indicated at 143, in response to another instruction issued by the read only memory 77. If the preceding underscore character happened to align with the righthand edge of the last character, the examination 143 will lead to a null detection which causes the read only memory 77 to return to the scan buffer instruction 122. Otherwise, however, the examination 143 will show that one more underscore character is required to provide the desired alignment. Consequently, in the absence of a null, the read only memory 77 furnishes an instruction, as indicated at 144, which causes the escapement related code word for the printer section 87 to be incremented by an amount representative of the width of the data remaining to be underscored so that the carriage 29 is moved into position for printing the last under score character. Next, the read only memory 77 issues another instruction, as indicated at 145, whereby the read only memory supplies an appropriate character related code word to the printer section 87 for printing the last underscore character with the maximum permissible ribbon advance. Finally, the read only memory 77 recycles to the scan buffer instruction 122.

CONCLUSION

In view of the foregoing, it will now be understood that the present invention provides methods and means for printing substantially straight and uniformly dense underscoring lines with automatic typewriters and the like having hammer-type impact printing mechanism. Moreover, it will be appreciated that provision has been made for automatically centering single and multiple character underscoring lines realtive to the character or characters which are to be underscored.

What is claimed is:

1. In a printer having a platen for supporting a copy carrier, a printing mechanism for serially printing successive characters on said copy carrier and drive means for moving said printing mechanism transversely of said platen, the improvement comprising a controller including escapement control means for selectively actuating said drive means on a per character basis to incrementally advance said printing mechanism into position to print said characters, said control means normally causing at least a predetermined per character linear advance of said printing mechanism to ensure that successive characters are printed in spaced apart relationship, means for entering an underscore command into said controller, and means responsive to said underscore command for signaling said escapement control means to limit the per character advance of said printing mechanism, while successive underscore characters are being printed, to a distance less than a predetermined underscore character width and less than said predetermined per character advance, whereby said printing mechanism is positioned in response to said underscore command to print successive underscore characters in overlapping relationship.

2. The improvement of claim 1 wherein said printing mechanism is an impact-type unit having a supply of inked ribbon for transferring said characters to said copy carrier, and another drive means coupled to said supply for advancing said ribbon; and said controller further includes ribbon advance control means for actuating said other drive means to bring a length of virgin ribbon stock into printing position in preparation for the printing of each of said characters; said length of virgin stock being selected to provide an underscoring line of substantially uniform density while being appreciably shorter than a predetermined nominal character with, whereby said ribbon is subjected to a multi-strike usage.

3. The improvement of claim 1 wherein underscoreable characters are printed in response to data words applied to said controller, each of said data words has a predetermined number of bits with a preselected one of said bits reserved for underscore signaling, non-underscore commands are executed in response to signals applied to said controller in a form distinguishable from said data words, said data words are applied to said controller with said preselected bits at a first logic level, and said underscore command responsive means comprises means for forcing the preselected bits of data words applied to said controller consecutively and without any intervening non-underscore command prior to an underscore command to a second logic level, thereby signaling that the characters printed in response to said consecutive data words are to be underscored.

4. The improvement of claim 3 wherein said controller further comprises means for determining a data width running from a forward edge to a rearward edge of any characters printed in response to consecutive data words having said selected bit at said second logic level, means for identifying the position of the printing mechanism while starting to print the characters represented by said consecutive data words, and means for relocating said printing mechanism in response to the identified printing mechanism position and the determined data width for printing said underscoring line in centered relationship relative to the characters to be underscored.

5. The improvement of claim 4 wherein the underscoring line is centered, if said data width is greater than said underscore character width, with a forward edge and a rearward edge vertically aligned with the forward edge and the rearward edge, respectively, of the characters to be underscored.

6. The improvement of claim 4 wherein the underscoring line is centered, if said underscore character width is greater than said data width, to have equal length borders extending to either side of the characters to be underscored.

7. The improvement of claim 3 wherein said printing mechanism is a hammer-type unit having a hammer, a supply of inked ribbon disposed between said hammer and said platen, a rotatably mounted character wheel positioned between said hammer and said platen for carrying a plurality of type elements, and a further drive means for indexing said character wheel to bring any one of said type elements into alignment with said hammer; underscoreable characters are entered into said controller by data words having a preselected number of bits with a predetermined one of said bits reserved for underscore signaling; and said controller comprises means for applying an escapement related code word to the drive means for the printing mechanism and for applying a character related code word to the drive means for said character wheel in response to each of said data words to position said printing mechanism and to bring a selected one of said type elements into alignment with said hammer in preparation for printing each of said characters.

8. The improvement of claim 7 wherein said printing mechanism further comprises another drive means coupled to said supply for advancing said ribbon, and means for actuating said other drive means in response to said character related code word for bringing a length of virgin ribbon stock into alignment with said hammer in preparation for printing each of said underscoreable characters; said length of virgin stock being selected to provide an underscoring line of substantially uniform density but being appreciably shorter than a nominal character width, whereby said ribbon is subject to a multi-strike usage.

9. In an automatic typewriter including a keyboard having a plurality of keys representing different underscoreable characters and other keys representing non-underscoreable commands, means for converting strokes of said underscoreable character keys into corresponding data words of predetermined bit length and for converting strokes of said non-underscoreable command keys into command signals having a form distinguishable from said data words, a platen for supporting a copy carrier, a printing mechanism for serially printing successive characters on said copy carrier, and drive means for moving said printing mechanism transversely of said platen; the improvement comprising a controller including buffer storage means for storing data words and command signals generated in response to said key strokes, means for entering an underscore command into said controller, means for scanning said stored data words and said command signals in response to said underscore command to alter all consecutive data words preceding said underscore command without interruption by a command signal to indicate that the characters corresponding to the altered data words are to be underscored, and an escapement control means responsive to the altered data words for repositioning said printing mechanism after the characters to be underscored have been printed with at least a predetermined per character advance and for then incrementally advancing the printing mechanism at a less than said predetermined advance per character rate of advance to print underscoring characters in overlapping relationship.

10. The improvement of claim 9 wherein said controller is adjustable means under the control of an operator to provide fixed or proportional character spacing, but said underscore characters are printed in overlapping relationship regardless of the character spacing selected.

11. The improvement of claim 10 further including means for operating said typewriter in a play-back mode in which said escapement control means responds to data words recorded on and then read from a recording medium.

12. A method for printing a substantially straight underscoring line on a platen supported copy carrier through the use of a hammertype impact printing mechanism having a hammer, an inked ribbon, and a character wheel positioned between said hammer and said ribbon to carry a plurality of different characters, including an underscore character; said method comprising the steps of advancing said printing mechanism for the printing of each of said characters, except for said underscore character, a distance sufficient to print said characters in spaced apart relationship; and limiting the per character advance of said printing mechanism, while printing said underscoring line, to an increment shorter than said distance and shorter than a predetermined underscore character width, whereby adjacent underscore characters are printed in overlapping relationship.

* * * * *

UNITED STATES PATENT AND TRADEMARK OFFICE

CERTIFICATE OF CORRECTION

PATENT NO. : 4,084,680

DATED : April 18, 1978

INVENTOR(S) : David R. Deetz

It is certified that error appears in the above-identified patent and that said Letters Patent are hereby corrected as shown below:

Column 14, change lines 55-59 to read as follows:

--character advance and for then incrementally advancing the printing mechanism at a per character rate of advance less than said predetermined advance to print underscoring characters in overlapping relationship.--

Column 14, line 61, after "adjustable", insert --by--.

Signed and Sealed this

Seventeenth Day of October 1978

[SEAL]

*Attest:*

RUTH C. MASON
*Attesting Officer*

DONALD W. BANNER
*Commissioner of Patents and Trademarks*